US005915923A

United States Patent [19]

Tomita et al.

[11] Patent Number: 5,915,923

[45] Date of Patent: Jun. 29, 1999

[54] GAS TURBINE MOVING BLADE

[75] Inventors: Yasuoki Tomita; Taku Ichiryu; Kiyoshi Suenaga, all of Takasago, Japan

[73] Assignee: Mitsubishi Heavy Industries, Ltd., Tokyo, Japan

[21] Appl. No.: 08/861,753

[22] Filed: May 22, 1997

[51] Int. Cl.[6] ..... F61D 5/18

[52] U.S. Cl. ..... 416/96 R; 416/97 R; 416/96 A; 415/115

[58] Field of Search ..... 416/95, 96 R, 416/96 A, 97 R; 415/115, 116

[56] References Cited

U.S. PATENT DOCUMENTS

| | | | |
|---|---|---|---|
| 2,873,087 | 2/1959 | Terrell et al. | 416/96 R |
| 2,920,865 | 1/1960 | Lombard | 416/96 R |
| 3,455,537 | 7/1969 | Kozlin et al. | 416/96 |
| 4,259,037 | 3/1981 | Anderson | 416/96 R |

FOREIGN PATENT DOCUMENTS

| | | | |
|---|---|---|---|
| 545792 | 9/1957 | Canada | 416/96 |

*Primary Examiner*—Christopher Verdier
*Assistant Examiner*—Richard Woo
*Attorney, Agent, or Firm*—Wenderoth, Lind & Ponack, L.L.P.

[57] ABSTRACT

A gas turbine moving blade in which the moving blade operating in a high temperature operating gas is cooled from its interior by steam and the steam after being used for the cooling is recovered, by use of a simple structure. A supply side passage (10), through which steam (6) is supplied directly into a cooling passage (51) of a blade leading edge side (11), is provided within a blade root portion (2) and a pocket (19). One end of the pocket is connected to the supply side passage and the other end of which is connected to a cooling passage (52) of a blade trailing edge side (12). The pocket is covered with a plate, which extends in a blade chord direction on an outer peripheral side face of the blade root portion between a blade platform and a rotor plate. Thus, efficiency of the gas turbine can be effectively enhanced.

6 Claims, 4 Drawing Sheets

GAS TURBINE MOVING BLADE

BACKGROUND OF THE INVENTION

1. Field of the Invention

The present invention relates to a gas turbine moving blade wherein there is formed, within a blade profile portion, a cooling passage for the flow of a cooling medium in a plurality of rows in a blade chord direction on a blade leading edge side and on a blade trailing edge side, respectively. Also formed within a blade root portion are a supply side passage connected to the respective cooling passage for supplying the cooling medium to the cooling passage and a discharge side passage connected to the respective cooling passage for discharging the cooling medium after used for cooling, so that the moving blade is cooled from its interior.

2. Description of the Prior Art

In a recent gas turbine moving blade using a high temperature operating gas of which a turbine inlet temperature is elevated, there is provided within a blade profile portion a cooling air passage in a plurality of rows in a blade chord direction for flow of a low temperature compressed air to cool the moving blade from its interior. Thus, a temperature of the moving blade exposed to the high temperature operating gas is lowered to or below an allowable value which is lower than a moving blade metal temperature and may maintain the structural strength.

In such air cooling of the moving blade, cooling air supplied into the moving blade passes through an inner cooling passage to provide convention cooling of the moving blade from its interior. The cooling air is then discharged into the high temperature operating gas flowing on an outer periphery of the moving blade through holes provided at a leading edge portion, a blade tip portion and a trailing edge portion of the moving blade, of which temperature is liable to be elevated due to the respective shape of structure, to provide film cooling of the edge or tip portions.

FIG. 4, is a longitudinal cross sectional view of a blade a thickness central portion of a prior art gas turbine moving blade. Cooling air passing through a moving blade interior provides cooling of the moving blade.

As shown in FIG. 4 in an interior of a blade profile portion 04 of a moving blade 01, there is provided a cooling passage 05 in a blade lengthwise direction between a blade root portion 02 and a blade tip portion 03. The cooling passage 05 is provided in a plurality of rows in a blade chord direction, which is a front and rear direction, of the moving blade 01 and is sectioned into a plurality of systems in the blade chord direction.

Cooling air 06 is introduced into the cooling passage 05 from an air passage provided within a rotor (not shown). The air flows to an outer periphery of the rotor of which the blade root portion 02 is fitted so as to be rotated together with the moving blade 01, via a supply side passage 010 provided within the blade root portion 02 and, while passing through within the moving blade 01 in the lengthwise direction between the blade root portion 02 and the blade tip portion 03, providing convection cooling of the moving blade 01 from its interior.

A portion of the cooling air 06 entering the supply side passage 010, after providing convection cooling of the moving blade 01, is discharged with a high velocity into a high temperature operating gas 013. The cooling air flows on an outer periphery of the moving blade 01, through openings 07 etc. provided at a leading edge portion 011 of the moving blade 01 so as to provide film cooling of a blade profile portion 04. Also, a portion of the cooling air 06, after providing convection cooling of a blade trailing edge portion 012, is discharged into the high temperature operating gas 013 through holes 08 provided at the blade trailing edge portion 012 and openings 09 provided at the blade tip portion 03.

Incidentally, in FIG. 4, numeral 014 designates a turbulator, which is disposed, transverse to a flow of the cooling air 06, within the cooling passage 05 for making the flow of the cooling air 06 turbulent so as to enhance the cooling efficiency.

As mentioned above, in the prior art gas turbine blade, there are employed various cooling structures so that a cooling is strengthened, a high temperature at a portion, where a blade thickness is made small for an operating efficiency of the moving blade 01. Therefore, where structural strength is small and a high temperature strength becomes severe, a structural strength is maintained and a lowering of efficiency is prevented.

Further, in a recent trend toward a high temperature gas turbine, use of higher temperature gas as an operating gas is contemplated for further improvement of a gas turbine thermal efficiency and, for this purpose, there are attempts to use a material which is excellent with respect to high temperature strength for the moving blade 01 as well as of further strengthening a cooling of the moving blade 01.

If compressed air is used as the cooling medium, as mentioned above, a sufficient cooling effect cannot be obtained due to the small thermal capacity. Hence, it is necessary to use steam as the cooling medium. Steam has a high thermal capacity and is able to enhance the cooling efficiency.

In a steam cooled blade in which cooling is effected by steam flowing within the moving blade 01, if the steam, after being used for cooling, is discharged into the high temperature operating gas 013, likewise the cooling air 06 mentioned above, the thermal efficiency of the gas turbine is lowered greatly. Thus, it is necessary that all the steam used for cooling is recovered from the interior of the moving blade 01 so that the thermal energy of the recovered steam can be recovered again by a steam turbine.

In other words, if a cooling method in which steam is discharged into a high temperature operating gas 013, likewise the cooling air 06, there occur problems such as temperature lowering of the high temperature operating gas 013 which is largely due to the steam discharge an internal efficiency of the turbine is substantially reduced. Also, there is no contribution of thermal energy recovered from the cooling of the moving blade 01 in an improvement of thermal efficiency of a gas turbine plant. Thus, an aimed improvement of thermal efficiency of the gas turbine is hindered.

Accordingly, if steam is used for cooling of the moving blade 01, there is a necessity of providing a discharge side passage within the blade root portion 02 for discharging the steam, after being used for cooling, from the cooling passage. While the following two points remain the same as in the above-mentioned air cooling, that is, a supply side passage is to be provided at the blade root portion 02 for supplying a flow rate of steam, which is necessary for cooling of the moving blade 01, into the cooling passage 05 and a supply side passage is to be provided both on the leading edge portion 011 side and the trailing edge portion 012 side of the blade for supplying a low temperature steam to the vicinity of the leading edge portion 011 and the trailing edge portion 012 where the high temperature strength becomes severe.

That is, a supply side passage is to be provided within the blade root portion 02 in the vicinity of the leading edge portion 011 and the trailing edge portion 012, respectively, of the moving blade 01 for supplying a low temperature steam into the respective cooling passage of the leading edge portion 011 and the trailing edge portion 012. Also, a discharge side passage is to be provided between the respective supply side passage within the blade root portion 02 for discharging the steam from the cooling passage in the vicinity of the central portion of the moving blade 01 for recovery of the steam after being used for cooling and having an elevated temperature.

Therefore, it becomes necessary to provide two systems of the supply side passage, having an increased passage area due to replacement of the cooling medium from air to steam and to provide at least one system of the discharge side passage to be disposed between the supply side passages. The systems are provided within the blade root portion 02 which has a small volume capacity, and there occurs a problem that arrangement of these passages becomes difficult.

SUMMARY OF THE INVENTION

In order to solve the problems associated with improving the thermal efficiency of a gas turbine, as mentioned above, it is an object of the present invention to provide a gas turbine moving blade in which a cooling medium is supplied from a supply side passage provided within a blade root portion directly into one of cooling passages of a blade leading edge portion and a blade trailing edge portion. A portion of the cooling medium diverges so as to flow, through a passage provided on a side face of the blade root portion, into the other of the cooling passages, into which the cooling medium is not supplied directly. Thus, the cooling medium is supplied into the cooling passages concurrently both on the blade leading edge portion and on the blade trailing edge portion through a single supply side passage provided within the blade root portion.

As a means to attain the object, the present invention provides a gas turbine moving blade constructed as follows.

A gas turbine moving blade comprises a cooling passage provided in a plurality of rows in a blade chord direction within a blade profile portion of the moving blade operating in a high temperature gas. A supply side passage is provided within a blade root portion of the moving blade so as to connect to the cooling passage for supplying a cooling medium into the cooling passage and a discharge side passage for discharging the cooling medium after passing through the cooling passage, so that the cooling medium cools the moving blade from its interior. Also, after being used for the cooling of the moving blade, the cooling medium is recovered from the interior of the moving blade. The cooling passage is provided each on a blade leading edge side and on a blade trailing edge side. Also, there is provided a pocket which extends in the blade chord direction on an outer side face of the blade root portion under a blade platform so that the cooling medium is supplied from the supply side passage into one of the cooling passages of the blade leading edge side and the blade trailing edge side. A portion of the cooling medium diverges so as to be supplied, via the pocket, into the other of the cooling passages.

Incidentally, the pocket may be formed by using the blade platform and a rotor plate provided on a side face of the blade root portion under the blade platform, as a portion of the structure.

Also, the pocket may be provided on one side face of the blade root portion on a ventral side or on a dorsal side of the moving blade, or on both side faces of same.

The cooling passage may be provided at a central portion of the moving blade, in addition to those provided on the leading edge portion and the trailing edge portion. Also, a cooling medium to be supplied in this case into the cooling passage of the central portion is supplied from a half way of the pocket.

Further, the cooling medium after passing through these cooling passages may be discharged separately into a discharge side passage connected to the respective cooling passage, or the cooling medium passing through the respective cooling passage may be joined together to be discharged into a common discharge side passage.

According to the gas turbine blade of the present invention so constructed as above, a supply side passage is provided only with respect to one of the leading edge side and the trailing edge side within the blade root portion which has a small volume capacity. Also, a cooling medium introduced into the supply side passage can be supplied directly to one of the cooling passages provided closely to the leading edge and the trailing edge. A portion of the cooling medium diverges from the supply side passage to be supplied, via the pocket, to the other of the cooling passages which does not directly connect to the supply side passage.

Thus, a low temperature cooling medium can be supplied to the respective cooling passage of the leading edge side and the trailing edge side from the supply side passage of the blade root portion directly or via the pocket. Thus, a high temperature at the leading edge side and the trailing edge side, where the structural strength is not sufficient, can be prevented. Thereby, the lowering of strength is lessened, a higher temperature operating gas becomes usable, and the thermal efficiency of the gas turbine can be enhanced.

Further, the cooling medium supplied to the cooling passage can be recovered outside of the moving blade, after cooling the moving blade from its interior. This avoids the high temperature operating gas being cooled by the discharge of the cooling medium into the high temperature operating gas. Thus, the thermal energy absorbed by the cooling medium can be recovered, so that the thermal efficiency of the gas turbine can be enhanced greatly.

Also, there is provided only one system of the supply side passage within the blade root portion and a portion of the cooling medium diverges to the leading edge side or the trailing edge side via the pocket provided on the outer side face of the blade root portion. Thus, the supply side passage, having an increased passage area for flow of steam, can be arranged within the blade root portion, which has a small volume capacity. This can be accomplished without much difficulty and yet a simple structure of the passage can be employed without the necessity of employing a complicated structure due to restriction of the arrangement.

The present invention further provides a gas turbine moving blade in which the pocket is provided on both outer side faces of the lower portion of the blade platform.

According to the gas turbine moving blade of the present invention as constructed above, supply of the cooling medium to the cooling passage etc. of the leading edge side or the trailing edge side, via the pocket, can be sufficient through such pockets formed with little projection from the side face of the blade root portion. Thus, an increased freedom in arrangement of the supply side passage within the blade root portion can be obtained.

The present invention also provides a gas turbine moving blade in which the cooling passages includes two systems of a leading edge side cooling passage having a leading edge cooling passage into which the cooling medium first flows on the blade leading edge side, and a trailing edge side cooling passage having a trailing edge cooling passage into which the cooling medium first flows on the blade trailing edge side. The cooling medium, after being used for the cooling of the moving blade through the respective cooling passage is joined at a blade central portion to be discharged into the discharge side passage.

According to the gas turbine moving blade of the present invention so constructed as above, a low temperature cooling medium can be supplied first to the leading edge cooling passage and the trailing edge cooling passage which are provided closely to the leading edge and the trailing edge, respectively, from the supply side passage of the blade root portion directly or via the pocket. Thus, the vicinity of the leading edge and the trailing edge, where a heating condition is most severe due to the high temperature operating gas, can be cooled effectively. Also, a high temperature at these locations can be prevented and lowered strength of these portions, which have less structural strength, can be lessened.

Also, the cooling medium after being used for cooling of the moving blade is joined at the blade central portion so as to be discharged into the discharge side passage. Thus, the number of the discharge side passages within the blade root portion can be limited to such a small number as one or two. Also, an increased freedom in arrangement of the discharge side passage within the blade root portion can be obtained.

The present invention also provides a gas turbine moving blade in which the leading edge side cooling passage is the cooling passage into which the cooling medium flows directly from the supply side passage. Also, the trailing edge side cooling passage is the cooling passage into which a portion of the cooling medium, diverging from that to be supplied from the supply side passage to the leading edge side cooling passage, flows via the pocket.

According to the gas turbine moving blade of the present invention as constructed above, in case of providing cooling of the moving blades arranged with a plurality of stages, the moving blades of the first stage which are driven by the highest temperature operating gas with the most severe heat condition are supplied first with a low temperature cooling medium so as to be cooled effectively. Then the moving blades of the second stage are cooled by the cooling medium after cooling the first stage moving blades. Thus, the passage of the cooling medium provided within the rotor etc. can be a single passage.

DESCRIPTION OF THE PREFERRED EMBODIMENTS

Figure 1:
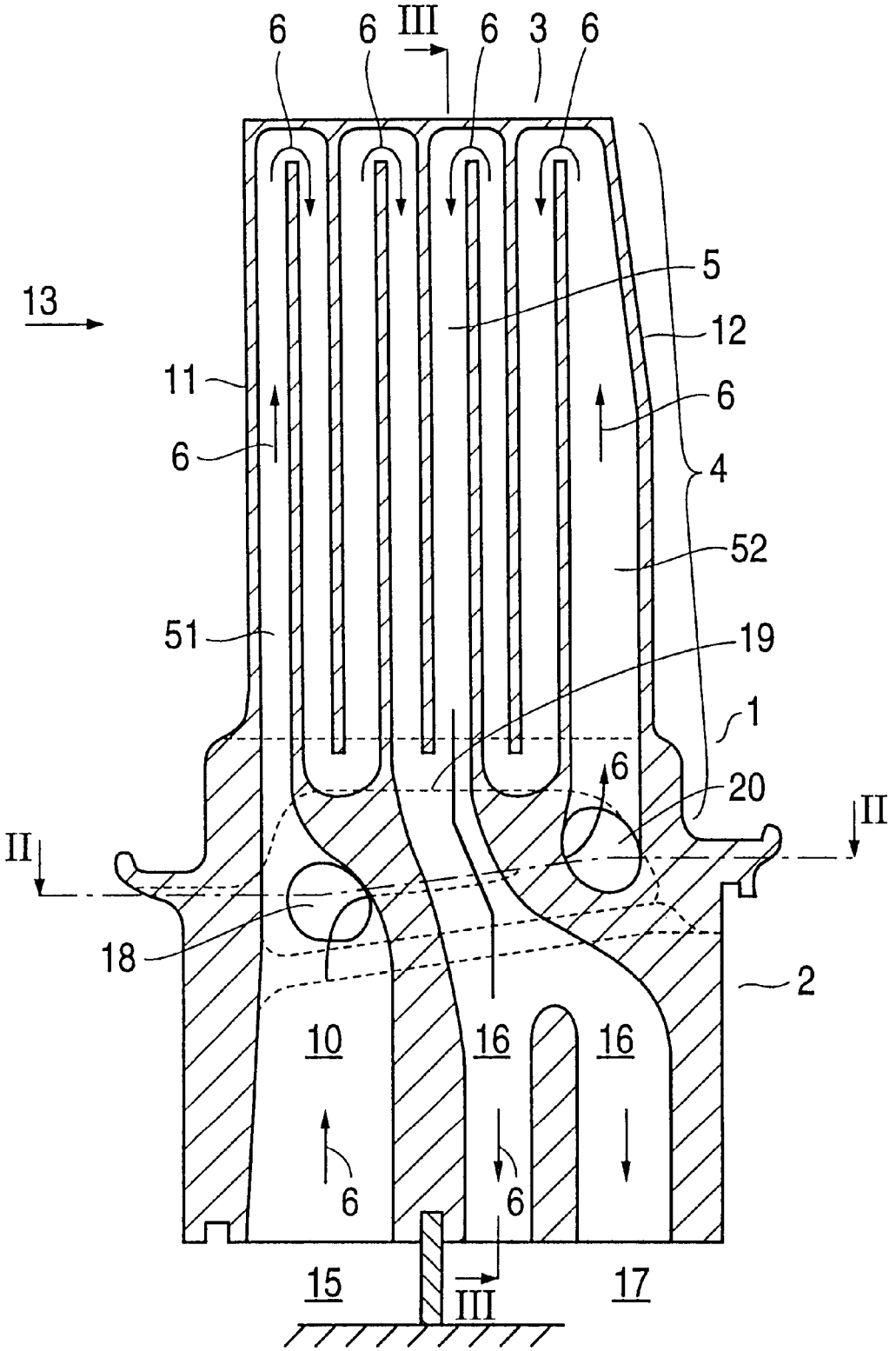
FIG. 1 is a longitudinal cross sectional view showing one preferred embodiment of a gas turbine moving blade according to the present invention.
Figure 2:
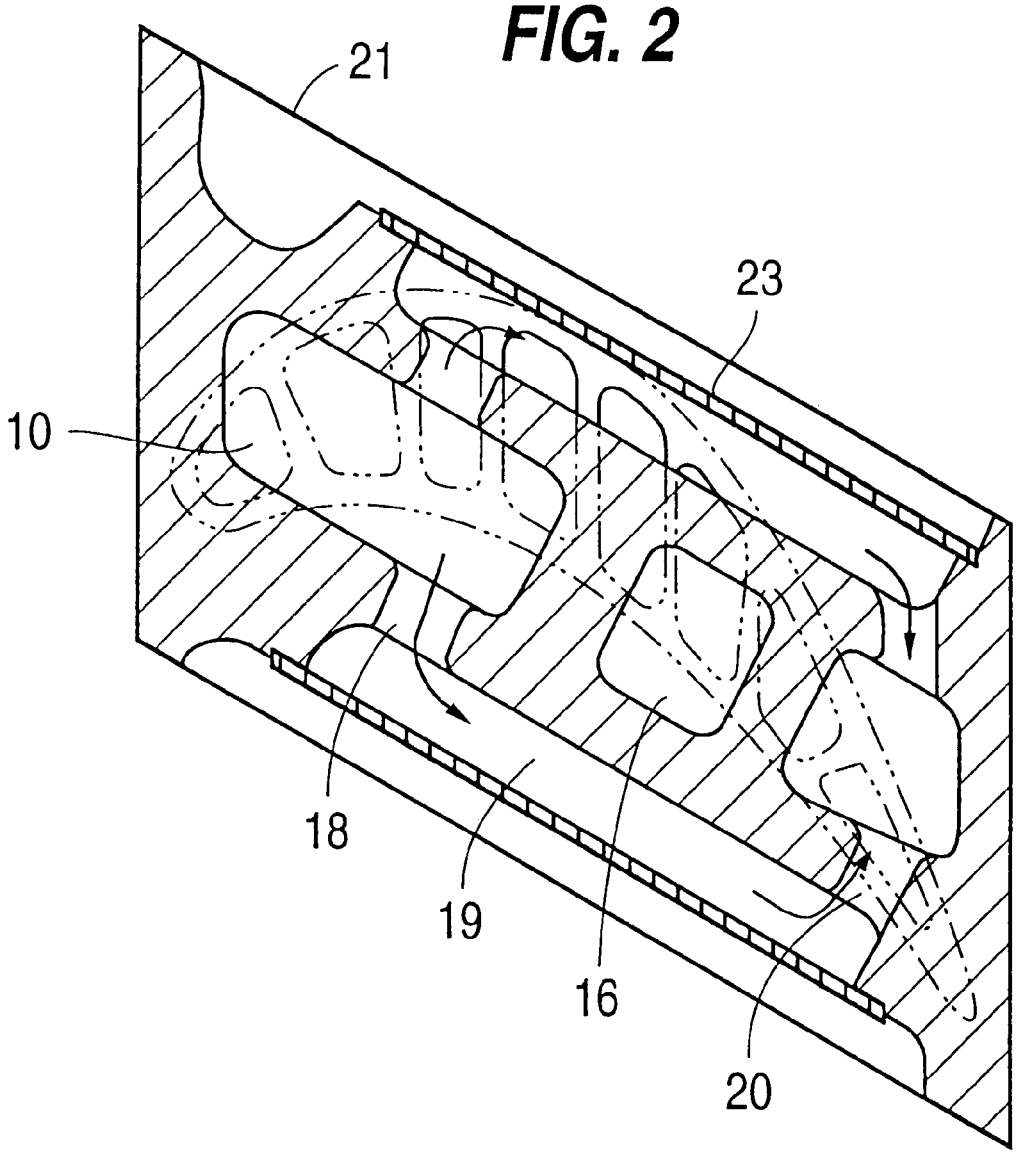
FIG. 2 is a cross sectional view taken on line II—II in the direction of arrows of FIG. 1.
Figure 3:
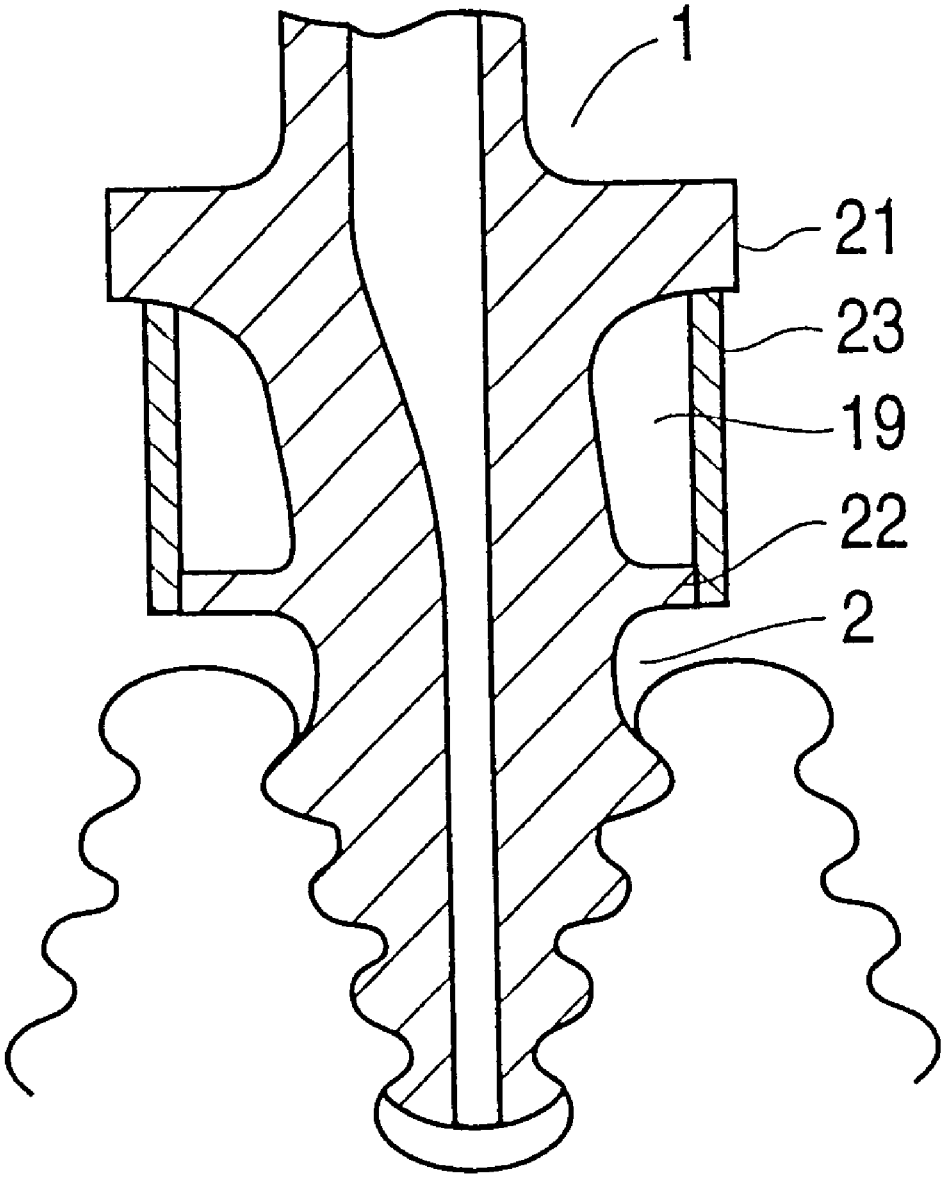
FIG. 3 is a partial cross sectional view taken on line III—III in the direction of arrows of FIG. 1.

The following description is made of one preferred embodiment of a gas turbine moving blade according to the present invention with reference to the drawing figures. FIG. 1 is a longitudinal cross sectional view of a blade thickness central portion of one preferred embodiment of a gas turbine moving blade according to the present invention, FIG. 2 is a cross sectional view taken on line II—II in the direction of arrows of FIG. 1 and FIG. 3 is a partial cross sectional view taken on line III—III in the direction of arrows of FIG. 1.

As shown in FIG. 1, within a blade profile portion 4 of a moving blade 1, there is provided a cooling passage 5 extending in a lengthwise direction between a blade root portion 2 and a blade tip portion 3, through which steam 6 as a cooling medium passes to effect cooling of the moving blade 1 from the blade interior.

Figure 4:
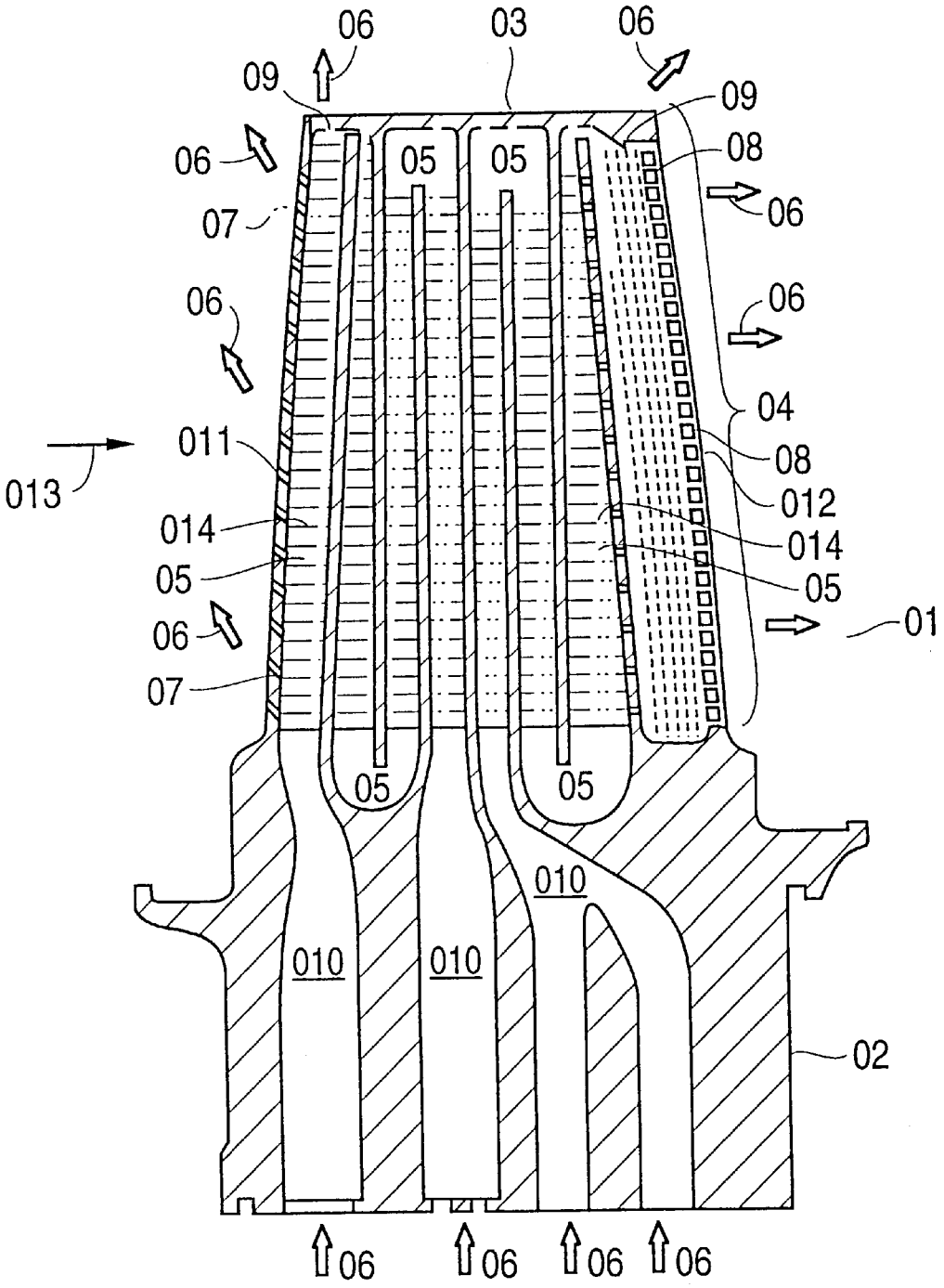
FIG. 4 PRIOR ART
FIG. 4 is a longitudinal cross sectional view of a prior art gas turbine moving blade which is cooled by cooling air.

In the cooling passage 5, likewise in FIG. 4, there are provided turbulators (not shown) which extend across the flow direction of the steam 6 for making the flow of the steam 6 passing through the cooling passage 5 turbulent so as to enhance the cooling efficiency.

The cooling passage 5 is provided in a plurality of rows in a blade chord direction, or in a front and rear direction, which extend from a leading edge toward a trailing edge of the moving blade 1.

Low temperature steam 6 is introduced into a supply side passage 10 provided on a leading edge side 11 within the blade root portion 2 from a steam passage 15 provided within a rotor (not shown). The blade root portion 2 is fitted on an outer periphery of the rotor so as to be rotated together with the moving blade 1. The steam 6 flows directly into a leading edge cooling passage 51 of the cooling passage 5 provided on the leading edge side 11 and to a blade tip portion 3. The flow of steam 6 then turns at the blade tip portion 3 and flows to the blade root portion 2 through the cooling passage 5, provided rearwardly of the leading edge cooling passage 51 and forms a leading edge side cooling passage together with the leading edge cooling passage 51. The cooling passages provide convection cooling of the moving blade 1 from the blade interior while passing through the cooling passage 5.

After making one more going and returning passes between the blade root portion 2 and the blade tip portion 3, the steam 6 flows to the blade root portion 2 through the cooling passage 5 formed in a blade central portion so as to be discharged from a discharge side passage 16 into a steam passage 17 provided separately from the supply side passage 10 within the rotor.

A portion of the low temperature steam 6, flowing into the supply side passage 10, flows to a trailing edge side 12 via a connection hole 18 which communicates with the supply side passage 10, a pocket 19 (described later) and a connection hole 20 which communicates with a trailing edge cooling passage 52 which is outermost relative to the cooling passage 5 in a direction towards the trailing edge side 12.

The low temperature steam 6 flows through the trailing edge cooling passage 52 to the blade tip portion 3. The passage turns at the blade tip portion 3 so that steam flows to the blade root portion 2 through the cooling passage 5, which is provided frontward of the trailing edge cooling passage 52. The passage 5 forms a trailing edge side cooling passage together with the trailing edge cooling passage 52, and effects convection cooling of the moving blade 1 from the blade interior while passing through the cooling passage 5.

After making one more passes going and returning between the blade root portion 2 and the blade tip portion 3, the steam 6 flows to the blade root portion 2 through the cooling passage 5 at a central portion of the blade. The steam is then discharged from the discharge side passage 16 into the steam passage 17 provided separately from the supply side passage 10 within the rotor.

As for the pocket 19, as shown in FIGS. 2 and 3, a blade platform 21 and a rotor plate 22, both projecting from a side face of the blade root portion 2, are used as structural members forming the pocket. A section of an underside end portion of the blade platform 21 and an outer side face of the rotor plate 22 is covered by a plate 23 so that a passage extending from the leading edge portion 11 toward the trailing edge portion 12 is formed on the side face of the blade root portion 2.

The leading edge side 11 of the pocket 19 is connected to the supply side passage 10 via the connection hole 18 provided at the side face of the blade root portion 2. The trailing edge side 12 of the pocket 19 is connected to the trailing edge cooling passage 52 via the connection hole 20 provided at the side face of the blade root portion 2.

According to the gas turbine moving blade of the preferred embodiment so constructed as above, the steam 6 introduced into the supply side passage 10 flows directly into the leading edge cooling passage 51 and a portion thereof flows into the trailing edge cooling passage 52 via the connection hole 18 provided at the side face of the blade root portion 2, the pocket 19 formed between the blade platform 21 and the outer periphery of the rotor plate 22 so as to extend in the blade chord direction and the connection hole 20 provided at the side face of the blade root portion 2 of the trailing edge side 12. Thus, the leading edge side 11 and the trailing edge side 12 of the moving blade 1, where the thermal load is high, are effectively cooled by the low temperature steam 6 and a high temperature of the moving blade 1 is prevented.

Also, the steam 6 after passing through the leading edge cooling passage 51 and the trailing edge cooling passage 52, respectively, flows zigzag through the respective cooling passage 5 of the leading edge side cooling passage and the trailing edge side cooling passage toward the blade central portion 4 and finally passes through the discharge side passage 16 and is discharged into the steam passage 17 to be recovered.

Thus, the low temperature steam 6 is supplied directly into the leading edge cooling passage 51 of the leading edge side 11, where the thermal load is high, from the supply side passage 10. The low temperature steam is also supplied concurrently via the pocket 19 into the trailing edge cooling passage 52 of the trailing edge side 12, where the thermal load is also high. The steam is then supplied to a central portion of the blade 4 where the cooling load is low. Thus, the cooling efficiency of the moving blade 1 is enhanced, especially at the leading edge side 11 and the trailing edge side 12, where the structural strength is low, and therefore high temperatures can be prevented efficiently and lowering of the strength can be suppressed. Hence an operating gas of a higher temperature becomes usable and the thermal efficiency of the gas turbine can be enhanced.

Also, the leading edge side 11 of the moving blade 1 can be effectively cooled even if film cooling is not applied. Therefore, discharge of the steam 6 into the high temperature operating gas to provide film cooling becomes unnecessary. Accordingly, there is no occurrence of temperature reduction of the high temperature operating gas due to the discharge of the steam 6, and the thermal energy absorbed by the steam 6 while cooling the moving blade 1 drives a steam turbine etc. to generate power, and thus the thermal efficiency of the gas turbine can be enhanced.

Further, there may be provided only one system of the supply side passage 10 and the discharge side passage 16, respectively, within the blade root portion 2. Thus, there is no difficulty with respect to the arrangement of the supply side passage 10 and the discharge side passage 16, where the passage area is large, within the blade root portion, where the volume is small. The structure of the passage can also be simplified.

As described above, according to the gas turbine moving blade of the present invention, the cooling medium after being used for cooling can be recovered without being discharged into the high temperature operating gas. Also, the cooling medium is first supplied to a portion of the moving blade where the thermal load is higher and then is recovered from a portion where the thermal load is lower. Thus, the cooling efficiency is improved and high temperatures at the leading edge portion and the trailing edge portion, where the high temperature strength is low, can be prevented, thereby significantly contributing to the enhancement of the gas turbine efficiency.

Also, the structure of the blade root portion can be simplified, the manufacturing costs can be reduced and high reliability can be realized.

While the preferred form of the present invention has been described, variations thereto will occur to those skilled in the art within the scope of the present inventive concepts which are delineated by the following claims.

What is claimed is:

1. A gas turbine blade comprising:

a blade root portion including a cooling medium supply passage formed therein and a cooling medium discharge passage formed in said blade root portion;

a blade platform projecting from said blade root portion;

a blade profile portion extending from said blade platform, said profile portion having a leading edge side and a trailing edge side;

a first cooling passage having a first longitudinal pass which extends through said blade profile portion along said leading edge side, said first cooling passage further having a plurality of subsequent longitudinal passes through said blade profile portion, said first pass and said subsequent passes being arranged in a blade profile chord direction;

a second cooling passage having a first longitudinal pass which extends through said blade profile portion along said trailing edge side, said second cooling passage having a plurality of subsequent longitudinal passes through said blade profile portion, said first pass and said subsequent passes being arranged in the blade profile cord direction; and a pocket formed along an outer side face of said blade root portion below said blade platform, said pocket extending in said blade chord direction and communicating said first cooling passage with said second cooling passage so that cooling medium can be supplied from said cooling medium supply passage into one of said first and second cooling passages while a portion of said cooling medium can be diverted to the other of said first and second cooling passages, wherein said first and second cooling passages communicate with said cooling medium discharge passage so that cooling medium flowing through said first and second cooling passages will be discharged through said cooling medium discharge passage where the cooling medium can be recovered from the interior of said gas turbine blade.

2. The gas turbine blade as claimed in claim 1, further comprising a second pocket provided on an opposite outer side face of said blade root portion under said blade platform.

3. The gas turbine blade as claimed in claim 1, wherein the last longitudinal pass, relative to the direction of flow, of each of said first and second cooling passages is located at a central portion of said blade profile portion so that cooling medium flowing through said first and second cooling passages will be discharged through said cooling medium discharge passage.

4. The gas turbine blade as claimed in claim 1, wherein said first cooling passage is located so as to be able to directly receive cooling medium from said cooling medium supply passage, while said second cooling passage is located so as to be able to receive cooling medium from said cooling medium supply passage via said pocket.

5. The gas turbine blade as claimed in claim 1, further comprising:

a projection extending from a side face of said blade root portion below said platform; and a plate engaging a surface of said projection and an underside surface of said platform, wherein said pocket is defined by said outer side face of said blade root portion, an upper face of said projection, said underside surface of said platform, and said plate.

6. The gas turbine blade as claimed in claim 5, wherein said plate engages an outer face of said projection.

* * * * *